US007764176B2

(12) United States Patent
Zhang et al.

(10) Patent No.: US 7,764,176 B2
(45) Date of Patent: Jul. 27, 2010

(54) ENTRY AND EXIT CONFIRMATION SYSTEM AND METHOD

(75) Inventors: Kailai Zhang, Shanghai (CN); Jichuang Xu, Beijing (CN); Wenhao Qin, Chengdu (CN)

(73) Assignee: Honeywell International Inc., Morristown, NJ (US)

( * ) Notice: Subject to any disclaimer, the term of this patent is extended or adjusted under 35 U.S.C. 154(b) by 305 days.

(21) Appl. No.: 11/957,273

(22) Filed: Dec. 14, 2007

(65) Prior Publication Data

US 2009/0153333 A1 Jun. 18, 2009

(51) Int. Cl.
*G08B 13/14* (2006.01)

(52) U.S. Cl. ..... 340/572.1; 340/10.1; 340/10.5; 340/505

(58) Field of Classification Search ..... 340/572.1, 340/10.1, 505
See application file for complete search history.

(56) References Cited

U.S. PATENT DOCUMENTS 7,164,354 B1 * 1/2007 Panzer ..... 340/539.15
7,619,525 B2 * 11/2009 Kwan ..... 340/572.1
2006/0082438 A1 4/2006 Bazakos et al.
2006/0158308 A1 * 7/2006 McMullen et al. ..... 340/5.61
2007/0247315 A1 * 10/2007 Nagai et al. ..... 340/572.4
2009/0140852 A1 * 6/2009 Stolarczyk et al. ..... 340/539.13

* cited by examiner

*Primary Examiner*—Travis R Hunnings
(74) *Attorney, Agent, or Firm*—Husch Blackwell Sanders Welsh & Katz

(57) ABSTRACT

A method for confirming entry and/or exit state of a mobile object relative to all entrance of an underground passageway by utilizing Radio Frequency Identification (RFID) technology. At least one RFID tag is physically attached to the mobile object. At least a first RFID reader and a second RFID reader, each having a monitoring range and being in communication with the RFID tag, are disposed at the entrance and a relatively inner position of the passageway respectively. The method comprises generating a first entering-state data if the RFID tag enters the monitoring range of the first RFID reader and a first exiting-state data if the RFID tag exits the monitoring range of the first RFID reader, generating a second entering-state data if the RFID tag enters the monitoring range of the second RFID reader and a second exiting-state data if the RFID tag exits the monitoring range of the second RFID reader, and processing the first entering-state and exiting-state data and the second entering-state and exiting-state data to generate an output data indicating the entry and/or exit state of the mobile object relative to the entrance of the passageway.

10 Claims, 5 Drawing Sheets

ENTRY AND EXIT CONFIRMATION SYSTEM AND METHOD

BACKGROUND OF THE INVENTION

1. Field of the Invention

The present invention generally relates to an object monitoring system and method. More particularly, this invention relates to an entry and exit confirmation system and method which utilizes RFID (Radio Frequency Identification) technology to confirm the entry and exit of a mobile object relative to the entrance of a passageway in an underground environment by processing the entering-state and exiting-state data of the mobile object.

2. Related Art

Object tracking and monitoring technology is now widely applied in industries and to people's lives. An example of the circumstances for applying the technology is the mining industry where mineworkers normally carry out the mining operation underground. The underground mining operations typically require the workers to travel within a complex arrangement of underground passageways in the mine. A large amount of underground passageways connect with each to form a complex network for providing commuting channels for the workers and conveying ores to the surface cites. Generally, the workers are spread at different locations in the passageways after they have entered the mine, and are instructed to exit the mine, for example, at the end of a working day or under emergencies. Thus, in order to improve the safety, it is necessary to guarantee that all the workers in the mine have successfully exited the mine or the workers in a specific passageway have successfully exited the passageway.

In addition, due to the complicated and unpredictable geological and geographic conditions, catastrophic event may happen locally or globally within the mine. For example, the density of a poisonous gas may reach a lethal level after an area of a coalmine has been exploited to a certain degree, under which condition all the workers must be evacuated from the underground passageways and ultimately exit the mine. Another example is that a local cave-in occurs and some of the workers are trapped in the underground passageways, under which condition all the other workers must be evacuated and rescue efforts must implemented immediately. The rescue would be greatly expedited if the information of whether the workers have exited the mine and/or a specific underground passageway is known in advance.

Therefore, it would be very advantageous to confirm the entry and/or exit of a mineworker relative to the entrance of the mine or the entrance of a specific underground passageway.

SUMMARY OF THE INVENTION

In view of the foregoing and other problems, the present invention provides an entry and/or exit confirmation system and method, which utilizes at least two RFID readers to track the moving direction of an mobile object and Per confirm the entry and/or exit of the object relative to the entrance of an underground passageway.

The present invention provides a method for confirming entry and/or exit of a mobile object relative to an entrance of an underground passageway by RFID technology, wherein at least one RFID tag is physically attached to the mobile object and at least a first RFID reader and a second RFID reader, each having a monitoring range and being in communication with the RFID tag, are disposed at the entrance and an relatively inner position of the passageway respectively. The method includes the steps of generating a first entering-state data if the RFID tag enters the monitoring range of the first RFID reader and a first exiting-state data if the RFID tag exits the monitoring range of the first RFID reader; generating a second entering-state data if the RFID tag enters the monitoring range of the second RFID reader and a second exiting-state data if the RFID tag exits the monitoring range of the second RFID reader; processing the first entering-state and exiting-state data and the second entering-state and exiting-state data to generate an output data indicating the entry and/or exit state of the mobile object relative to the entrance of the passageway.

In one aspect of the method, the method Her includes providing a first backup RFID reader associated with the first RFID reader and in communication with the RFID tag, and a second backup RFID reader associated with the second RFID reader and in communication with the RFID tag.

In another aspect of method, the method further includes attaching an alarm device to the mobile object, obtaining an comparable data from an database indicating a desirable entry and/or exit state of the mobile object relative to the entrance of the passageway, comparing the output data with the comparable data, and transmitting a signal to activate the alarm device if the output data is not compatible with the comparable data.

In yet another aspect of the method, generating a first entering-state data and a first exiting-state data includes generating a first entering time if the RFID tag enters the monitoring range of the first RFID reader and generating a first exiting time if the RFID tag exits the monitoring range of the first RFID reader, and generating a second entering-state data and a second exiting-state data includes generating a second entering time if the RFID tag enters the monitoring range of the second RFID reader and generating a second exiting time if the RFID tag exits the monitoring range of the second RFID reader. Preferably, processing the first entering-state and exiting-state data and the second entering-state and exiting-state data comprises comparing the time sequences of the first entering time, the first exiting time, the second entering time and the second exiting time.

In still another aspect of the method, the method her includes transmitting the output data to a display for displaying the entry and/or exit state of the mobile object relative to the entrance of the passageway.

The present invention also provides a computer readable medium having computer readable program for operating on a computer for confirming entry and/or exit of at least one mobile object relative to an entrance of a passageway by utilizing Radio Frequency Identification (RFID) technology, wherein at least one RFID tag is physically attached to the mobile object and at least a first RFID reader and a second RFID reader, each having a monitoring range and being in communication with the RFID tag, are disposed at the entrance and an relatively inner position of the passageway respectively. The method includes the steps of generating a first entering-state data if the RFID tag enters the monitoring range of the first RFID reader and a first exiting-state data if the RFID tag exits the monitoring range of the first RFID reader; generating a second entering-state data if the RFID tag enters the monitoring range of the second RFID reader and a second exiting-state data if the RFID tag exits the monitoring range of the second RFID reader; processing the first entering-state and exiting-state data and the second entering-state and exiting-state data to generate an output data indicating the entry and/or exit state of the mobile object relative to the entrance of the passageway.

The present invention also provides a system for confirming entry and/or exit state of a mobile object relative to an entrance of an underground passageway by utilizing Radio Frequency Identification (RFID) technology, wherein at least one RFID tag is physically attached to the mobile object and at least a first RFID reader and a second RFID reader, each having a monitoring range and being in communication with the RFID tag, are disposed at the entrance and an relatively inner position of the passageway respectively. The system includes a first state data generating component for generating a first entering-state data if the RFID tag enters the monitoring range of the first RFID reader and a first exiting-state data if the RFID tag exits the monitoring range of the first RFID reader, a second state data generating component for generating a second entering-state data if the RFID tag enters the monitoring range of the second RFID reader and a second exiting-state data if the RFID tag exits the monitoring range of the second RFID reader, and a data processing component for processing the first entering-state and exiting-state data and the second entering-state and exiting-state data to generate an output data indicating the entry and/or exit state of the mobile object relative to the entrance of the passageway.

Although an exemplary embodiment of the system and method according to the present invention will be described in connection with an underground mine environment, it should be recognized the system and method is applicable to any other suitable circumstances.

BRIEF DESCRIPTION OF THE DRAWINGS

These and other features, benefits and advantages of the present invention will become apparent by reference to the following text figures, with like reference numbers referring to like structures across the views, wherein.

DETAILED DESCRIPTION OF THE INVENTION

The present invention now will be described in detail hereinafter with reference to the accompanying drawings, in which preferred embodiments of the invention are shown. However, this invention may be embodied in many different forms and should not be construed as limited to the embodiments set forth herein. Like numerals refer to like elements throughout.

Hereinafter, one exemplary embodiment of the system and method for confirming entry and/or exit state of a mobile object relative to an entrance of a passageway according to the present invention will be described in connection with an underground mine environment within which a plurality of mineworkers move. However, it should be recognized that the application of the method and system according to the present invention is not limited to the underground mine environment. Rather, the method is applicable to any other suitable circumstances, where confirmation of entry and/or exit state of a mobile object relative to an entrance of a passageway is required.

Figure 1:
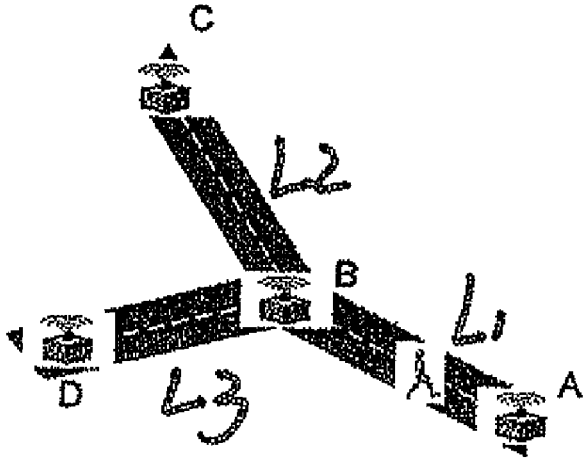
FIG. 1 is a schematic view illustrating a passageway environment, wherein three passageways are connected with each other and at least one RFID reader is disposed at the entrance of each passageway.

FIG. 1 illustrates an underground passageway environment, such as a coalmine. As shown in FIG. 1, three underground passageways L1, L2 and L3 are connected with each other to form a typical three-way commuting arrangement, within which a mineworker moves to carry out different mining tasks. At least one RFID tag, electronically programmed with unique identification information and other information, is physically attached to the worker. A plurality of RFID readers, for example, four RFID readers A-D in the figure, are disposed strategically within the passages to be in data communication with the RFID tag. Each of the RFID readers emits radio waves in a range of several centimeters to 50 meters or more, depending on the output power of the reader, thereby establishing a predetermined electromagnetic zone as a monitoring range. If the mineworker is within the electromagnetic zone, the RFID reader is in data communication with the RFID tag carried by the mineworker by decoding the data encoded in the RFID tag and sends the data to an external server for processing. In addition, the RFID tag sends out wireless signals if it enters or exits the monitoring range of an RFID reader.

In this embodiment, four RFID readers A-D are disposed within the passages to monitor the movement of the RFID tag. The RFID reader A is disposed at the entrance of passageway L1, the RFID reader C is disposed at the entrance of passageway L2, and the RFID reader D is disposed at the entrance of passageway L3. The RFID reader B is disposed at the intersection of the three passageways, and is shared by the passageways as a second RFID reader disposed within the passageway. However, it should be recognized that the intersection of the passageways can be taken as a common entrance of the passageways and accordingly the RFID reader B is disposed at the entrance of the passageways.

Figure 1A:
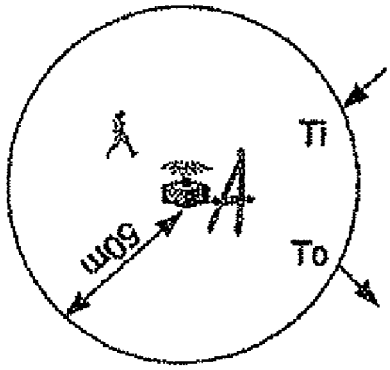
FIG. 1A is a schematic view showing the monitoring range of one of the RFID readers in FIG. 1 and the movement of a mineworker relative to the monitoring range.

As shown in FIG. 1, the mineworker is moving within passageway L1 to the RFID reader A. FIG. 1A illustrates the monitoring range of the RFID reader A and the movement of the mineworker relative to the reader. As shown in FIG. 1A, assuming RFID reader A is disposed at the entrance of the passageway L1, an entering time Ti is generated based on the wireless signal sent out by the RFID tag if the mineworker enters the monitoring range of the RFID reader A. Similarly, an exiting time To is generated based on the wireless signal sent out by the RFID tag if the mineworker exits the monitoring range of the RFID reader A.

However, it should be recognized that the entering time Ti is generated by the system as one example of an entering-state data if the RFID tag enters the monitoring range of the RFID reader and the exiting time To is generated by the system as one example of an exiting-state data if the RFID tag exits the monitoring range of the first RFID reader. The entering-state data and exiting-state data can be implemented and embodied by any other suitable parameters or arguments besides the time. For example, in an underground environment where the different segments of a passageway have different altitude, the entering-state data and exiting-state data could be the indicia of an altitude when the mineworker enters or exits the monitoring ranges of an RFID reader.

Referring back to FIG. 1A, since the mineworker can move into and out of the monitoring range of the RFID reader A from any possible direction, the entering time Ti and the exiting time To only are not sufficient to determine the moving direction of the mineworker. Thus, the entry and/or exit state of the mineworker relative to the entrance of the passageway cannot be confirmed.

In order to overcome the foregoing problem, the system according to one exemplary embodiment of the invention adopts at least two RFID readers, one of which is disposed at the entrance of the passageway and the other of which is disposed within the passageway relative to the first one. In the embodiment shown in FIG. 1, for example, the RFID reader A is disposed at the entrance of the passageway L1 and the RFID reader B is disposed within the passageway L1.

Figure 4:
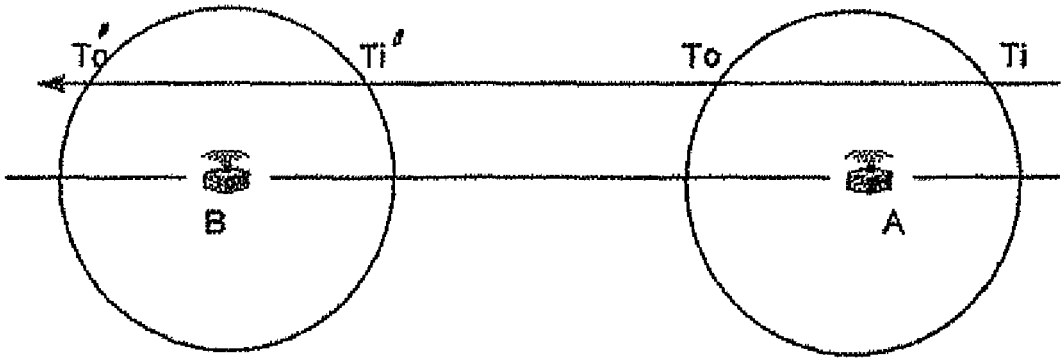
FIG. 4 is a schematic view showing the monitoring ranges of a pair of RFID readers in FIG. 1 and the movement of a mineworker relative to the monitoring ranges of the RFID readers.

Referring to FIG. 4, an entering time Ti' is generated if the mineworker enters the monitoring range of the RFID reader B and an exiting time To' is generated if the mineworker exits the monitoring range of the RFID reader B. Accordingly, Ti, To, Ti' and To' are processed by the system to determine the moving direction of the mineworker and Dryer confirm the entry and/or exit state of the mineworker relative to the entrance of the passageway L1, where the first RFID reader A is disposed.

Figure 2:
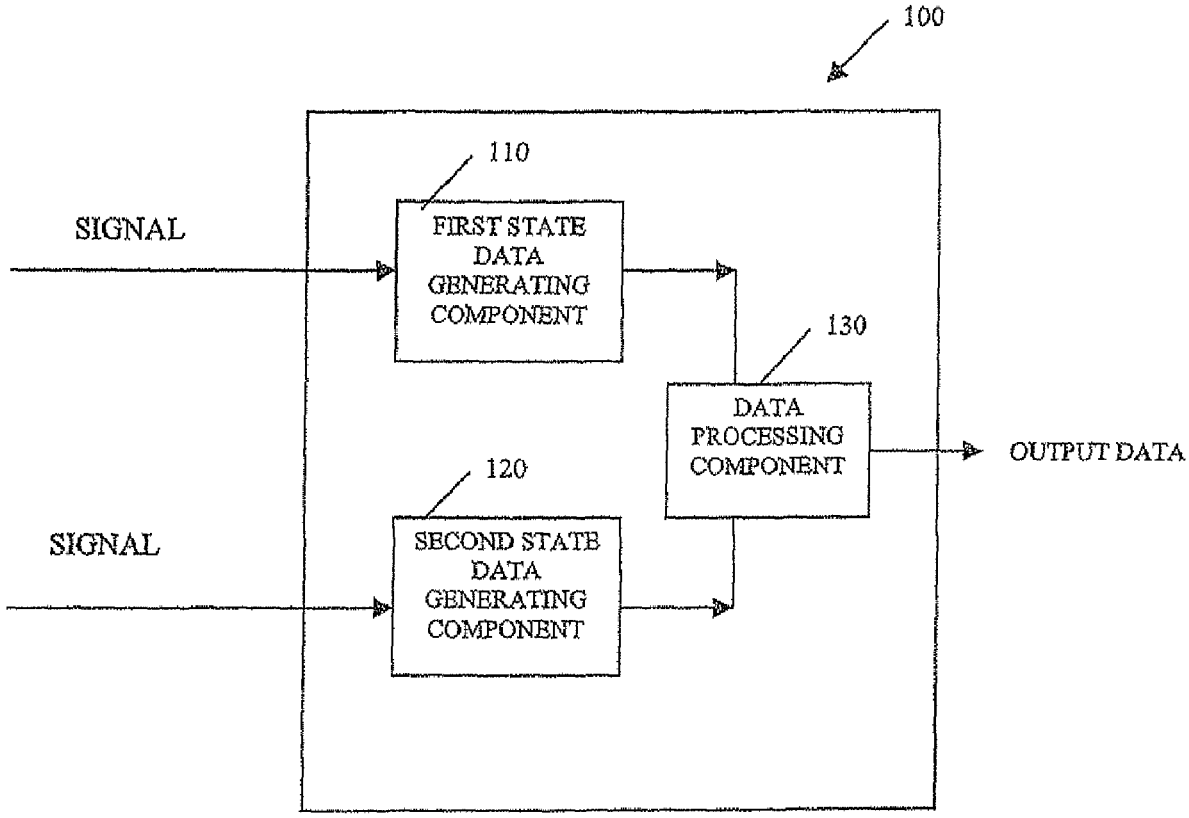
FIG. 2 is a block diagram of the system for confirming entry and/or exit of a mineworker relative to the entrance of a passageway according to one exemplary embodiment of the present invention.

Referring to FIG. 2, a block diagram schematically showing a system according to one embodiment of the present invention is illustrated. The system 100 includes a first state data generating component 110, a second state data generating component 120 and a data processing component 130.

The first state data generating component 110 receives wireless signals from a first RFID reader, such as the RFID reader A in FIG. 1, through a wireless protocol or through hardware, such as optical fibers, and generates a first entering-state state data if the RFID tag enters the monitoring range of the first RFID reader and a first exiting-state data if the RFID tag exits the monitoring range of the first RFID reader. Similarly, the second data processing component 120 receives wireless signals from a second RFID reader, such as the RFID reader B in FIG. 1, through a wireless protocol or through hardware, such as optical fibers, and generates a second entering-state state data if the RFID tag enters the monitoring range of the second RFID reader and a second exiting-state data if the RFID tag exits the monitoring range of the second RFID reader. The data processing component 130 is in data communication with the first state data generating component 110 and the second state data generating component 120, and functions to process the first entering-state and exiting-state data generated by the first state data generating component 110 and the second entering-state and exiting-state data generated by the second state data generating component 120, to generate an output data indicating the entry and/or exit state of the mineworker relative to the entrance of a passageway.

Note that the state data generating components 110 and 120 can also be configured to receive initial computer-readable data processed from the raw signals and further process the initial computer-readable data to obtain the record data related to the mineworker. The first and second state data can be, but is not limited to, the entering and exiting time of mineworker relative to the monitoring range of an RFID reader and so on. The first and second state data is subsequently transmitted, processed and utilized by the data processing component 120 to generate an output data that indicates the entry and/or exit state of the mineworker relative to the entrance of a passageway. Preferably, the output data is transmitted to a client for processing and displaying the output data.

It should be recognized that the component can be any computer-related entity as long as it is capable of executing the functionality thereof. For example, the component includes but not limited to hardware, software and a combination of hardware and software.

Figure 3:
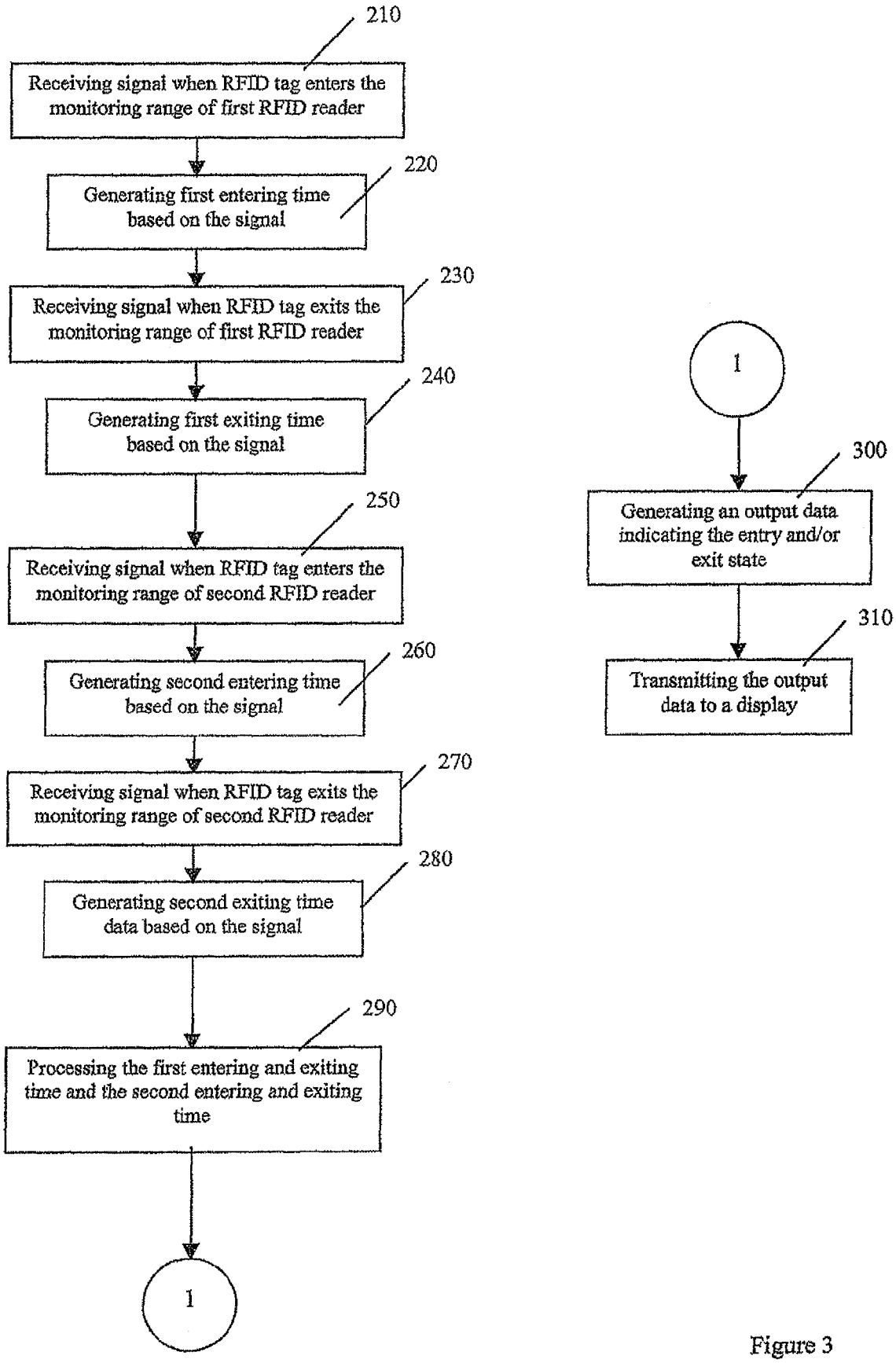
FIG. 3 is a flow chart illustrating the steps of the method for forecasting locations of a mobile object according to one exemplary embodiment of the present invention.

Referring now to FIG. 3, there is illustrated a flow chart of the steps of a method according to one exemplary embodiment of the present invention. Although the steps of the embodiment are shown and described as a series of acts, it should be recognized that the present invention is not limited by the order of acts, as some acts may occur in different orders and/or concurrent with other acts. Moreover, not all illustrated acts are required to implement the embodiment of the method according to the present invention.

The exemplary embodiment of the method according to the present invention will be described hereafter in connection with an underground mine environment where a mineworker carrying an RFID tag moves in an underground passageway, wherein a first RFID reader A is disposed at the entrance of the passageway and a second RFID reader B is disposed within the passageway.

At step 210 of the embodiment, the first state data generating component 110 of FIG. 2 receives wireless signals if the mineworker enters the monitoring ranges of the first RFID reader A. At step 220, the first state data generating component 110 generates a first entering time Ti, as an example of a first entering-state data, based on the received wireless signals. At step 230, the first state data generating component 110 receives wireless signals if the mineworker exits the monitoring ranges of the first RFID reader A. At step 240, the first state data generating component 110 generates a first exiting time To, as an example of a first exiting-state data, based on the received wireless signals.

At step 250 of the embodiment, the second state data generating component 120 of FIG. 2 receives wireless signals if the mineworker enters the monitoring ranges of the second RFID reader B. At step 260, the second state data generating component 120 generates a second entering time Ti', as an example of a second entering-state data, based on the received wireless signals. At step 270, the second state data generating component 120 receives wireless signals if the mineworker exits the monitoring ranges of the second RFID reader B. At step 280, the second state data generating component 110 generates a second exiting time To', as an example of a second-exiting state data, based on the received wireless signals.

At step 290, the first entering time Ti, the first exiting time To, the second entering time Ti' and the second exiting time To' are processed by the data processing component 130 of FIG. 2. At step 300, the data processing component 130 generates an output data indicating the entry and/or exit state of the mineworker relative to the entrance of the passage.

Preferably at step 310, the output data is transmitted to a display or a client, for displaying the result of the entry/exit state of the mineworker relative to the underground passageway.

Optionally, the system and method according to the embodiment of the present invention can provide an alarming functionality by providing an alarm device to the mineworker. Specifically, the system acquires a comparable data from an outside database. The comparable data records a desirable state of the mineworker relative to the entrance. For example, the comparable data indicates it is desirable that the mineworker enters the passageway and remains within the passageway. The system generates an output data indicating the entry and/or exit state of the mineworker relative to the passageway and compares the output data with the comparable data. If the output data is not compatible with the comparable data, the system send out a wireless signal to activate the alarm device attached to the mineworker, to inform him that he is deviated from the desirable track.

Preferably, the data processing component 130 compares the time sequences of the Ti, To, Ti' and To' to determine the moving direction and further confirm the entry and/or exit state of the mineworker.

Preferably, the system further includes a third RFID reader disposed between the first RFID reader and the second RFID reader. Thus, in the event that one of the first and second readers fails, the remaining functional RFID reader and the third RFID reader can provide another two-readers monitoring system to determine the moving direction and further confirm the entry and/or exit state of the mineworker. It is assumed that two or all of the three RFID readers fail at the same time is an event of absolute small probability. Thus, the configuration of three RFID readers is capable of providing a stable monitoring system.

Figure 8:
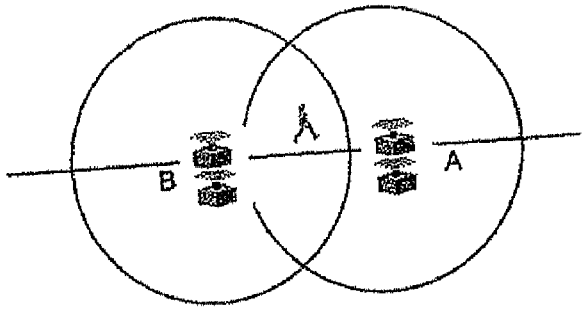
FIG. 8 is a schematic view showing the monitoring ranges of a pair of RFID readers in FIG. 7, with backup RFID readers, and the movement of a mineworker relative to the monitoring ranges of the RFID readers.

Preferable, the system drier includes features providing backup functionality to the first and second RFID readers. The backup functionality can be implemented by hardware or software. For example, a first backup RFID reader is associated with the first RFID reader A and a second backup RFID reader is associated with the second RFID reader B, thereby providing two pairs of RFID readers. The backup readers can be associated with the normal readers by any suitable measures, including but not limited to software and hardware implementations. For example, in the event the first RFID reader fails and stops to emits radio waves to form a monitoring range, the first backup RFID reader associated with the first RFID reader is capable of detecting the fading of radio waves and emitting radio waves instead. More preferably, the backup RFID readers send out an alarm to notify the system failure of a normal RFID reader. Preferably, the two RFID readers of the system have their monitoring ranges crossed. For example, FIG. 8 illustrates a configuration where the monitoring ranges of the two RFID readers are crossed and backup RFID readers are provided.

In addition, it should be recognized the mineworker may move into or out of the monitoring range of a specific RFID reader more than once. Thus, more than one entering-state data and more than one exiting-state data are generated and processed by the system. According to the embodiment of the present invention, all the history entering and exiting state data and the history record of the entry and/or state of the mineworker are processed by the system.

Figure 5:
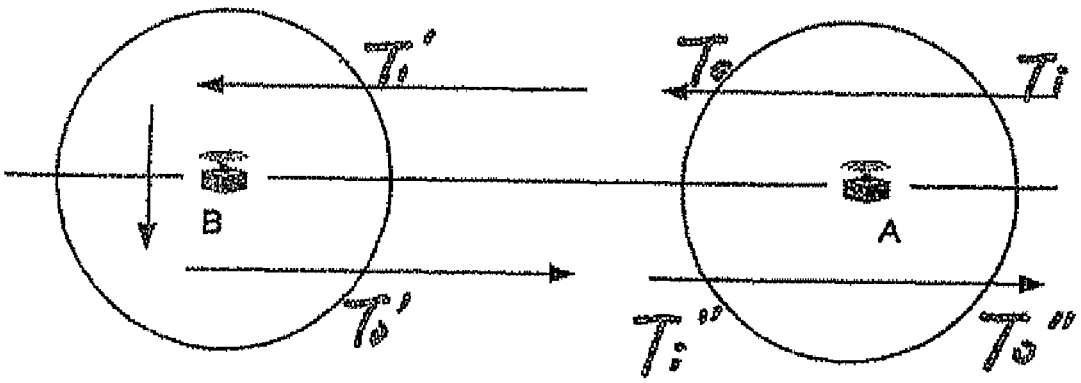
FIG. 5 is another schematic view showing the monitoring ranges of a pair of RFID readers in FIG. 1, with the monitoring ranges being not crossed with each other, and the movement of a mineworker relative to the monitoring ranges of the RFID readers.

FIG. 5 illustrates one occasion where the mineworker moves into and out of the monitoring range of an RFID reader more than once. As shown in FIG. 5, the mineworker moves into and out of the monitoring range of the first RFID reader A, moves into and out of the monitoring range of the second RFID reader B and then moves into and out of the monitoring range of the first RFID reader A again. According, besides the four data Ti, To, Ti' and To' shown in FIG. 4, Ti" and To" are also generated. Ti" is generated when the mineworker moves back into the monitoring range of the first RFID reader A and To" is generated when the mineworker again moves out of the monitoring range of the first RFID reader A. Thus, three groups of entering-state and exiting-state data are generated and processed by the system to confirm the entry and/or exit state of the mineworker.

Figure 6:
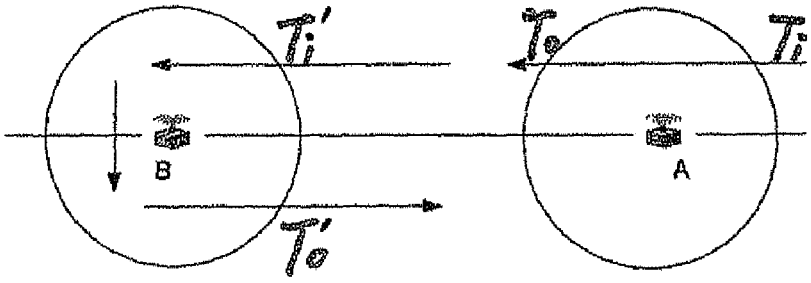
FIG. 6 is another schematic view showing the monitoring ranges of a pair of RFID readers in FIG. 1, with the monitoring ranges being not crossed with each other, and the movement of a mineworker relative to the monitoring ranges of the RFID readers.
Figure 7:
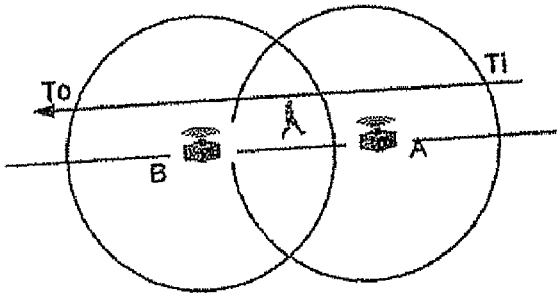
FIG. 7 is another schematic view showing the monitoring ranges of a pair of RFID readers in FIG. 1, with the monitoring ranges being crossed with each other, and the movement of a mineworker relative to the monitoring ranges of the RFID readers.

FIG. 6 illustrates one occasion where the mineworker moves into and out of the monitoring range of the first RFID reader A, moves into the monitoring range of the second RFID reader B, and subsequently moves out of the monitoring range of the second RFID reader B and stays between the two readers. In this case, both RFID readers are not able to detect the mineworker and send out monitored signal. Preferably, in order to solve this issue, the two RFID readers are disposed to have their monitoring ranges crossed, as illustrated in FIG. 7.

Preferably, the processing of the entering-state and exiting-state data is controlled by the finite state machine in the Appendix.

The invention has been described herein with reference to particular exemplary embodiments. Certain alterations and modifications may be apparent to those skilled in the art, without departing from the scope of the invention. The exemplary embodiments are meant to be illustrative, not limiting of the scope of the invention, which is defined by the appended claims.

APPENDIX: ENTERING/EXITING MINE FINITE STATE MACHINE

I: Entering/Leaving mine state list

S1. A, B reader normal, A monitored signal, B unknown signal

S2. A, B reader normal, A unknown signal, B monitored signal

S3. A, B reader normal, A, B both monitored signal

S4. A, B reader normal, A, B both unknown signal

S5. A reader failed, B monitored signal, C unknown signal

S6. A reader failed, B unknown signal, C monitored signal

S7. A reader failed, B, C monitored signal

S8. A reader failed, B, C unknown signal

S9. B reader failed, A monitored signal, C unknown signal

S10. B reader failed, A unknown signal, C monitored signal

S11. B reader failed, A, C monitored signal

S12. B reader failed, A, C monitored signal

S13. A, B, C all failed or two of them failed, emergency handle

II: Underground Personnel State List

ESM1: Unknown;

ESM2: Entered mine

ESM3: Leaved mine

III: Adjust Whether Entered/Exited Mine

P1. S4→S1=>ESM1

P2. S4→S1→S3 →S2(→S3→S2→ . . . )→S4=>ESM2

P3. S4 →S1→S3→S2(→S3→S2→ . . . )→S3→S1 (→S3→S1→ . . . )→S4=>ESM2+ESM3

P4. S4→S1 →S3 →S1(→S3→S1→ . . . )→S4=>ESM2+ESM3

P5. S4→S1→S4=>ESM1

P6. S4→S1→S4→S2(→S4→S2→ . . . )=>ESM2

P7. S4→S2=>ESM1

P8. S4→S2→S3→S1(→S3→S1→ . . . )→S4=>ESM3

P9. S4→S2→S3 →S1(→S3→S1→ . . . )→S3→S2 (→S3→S2→ . . . )→S4=>ESM3+ESM2
P10. S4→S2→S3 →S2(→S3→S2→ . . . )→S4=>ESM3+ ESM2
P11. S4→S2→S4=>ESM1
P12. S4→S2→S4→S1(→S4→S1 → . . . )=>ESM3
P13. S8→S5=>ESM1
P14. S8→S5→S7→S6(→S7→S6→ . . . )→S8=>ESM2
P15. S8→S5→S7→S6(→S7→S6→ . . . )→S7→S5 (→S7→S5→ . . . )→S8=>ESM2+ESM3
P16. S8→S5→S7→S5(→S7→S5→ . . . )→S8=>ESM2+ ESM3
P17. S8→S5→S8=>ESM1
P18. S8→S5→S8→S6(→S8→S6→ . . . )=>ESM2
P19. S8→S6=>ESM1
P20. S8→S6→S7→S5(→S7→S5→ . . . )→S8=>ESM3
P21. S8→S6→S7→S5(→S7→S5→ . . . )→S7→S6 (→S7>S6→ . . . )→S8=>ESM3+ESM2
P22. S8→S6→S7→S6(→S7→S6→ . . . )→S8=>ESM3+ ESM2
P23. S8→S6=>S8=>ESM1
P24. S8→S6→S8→S5(→S8→S5→ . . . )=>ESM3
P25. S12→S9=>ESM1
P26. S12→S9→S11→S10(→S11→S10→ . . . )→ S12=>ESM2
P27. S12→S9→S11→S10(→S11→S10→ . . . )→ S11→S9(→S11→S9→ . . . )→S12=>ESM2+ESM3
P28. S12→S9→S11→S9(→S11→S9→ . . . )→ S12=>ESM2+ESM3
P29. S12→S9→S12=>ESM1
P30. S12→S9→S12→S10(→S12→S10→ . . . )=>ESM2
P31. S12→S10=>ESM1
P32. S12→S10→S11→S9(→S11→S9→ . . . )→ S12=>ESM2
P33. S12→S10→S11→S9(→S11→S9→ . . . )→ S11→S10(→S11→S10→ . . . )→S12=>ESM2+ESM3
P34. S12→S10→S11→S9 (–S11→S9→ . . . )→ S12=>ESM2+ESM3
P35. S12→S10→S12=>ESM1
P36. S12→S10→S12→S9(→S12→S9→ . . . )=>ESM3
P37. S4→S1→S8→S5=>ESM1
P38. S4→S1→S8→S5→S7→S6(→S7→S6→ . . . )→ S8=>ESM2
P39. S4→S1→S8→S5→S7→S6(→S7→S6→ . . . )→ S7→S5(→S7→S6→ . . . )→S8=>ESM2+ESM3
P40. S4→S1→S8→S5→S7→S5(→S7→S5→ . . . )→ S8=>ESM2+ESM3
P41. S4→S1→S8→S5→S8=>ESM1
P42. S4→S1→S8→S5→S8→S6(→S8→S6→ . . . )=> ESM2
P43. S4→S1→S3→S5=>ESM1
P44. S4→S1→S3→S5→S7→S6(→S7→S6→ . . . )→ S8=>ESM2
P45. S4→S1→S3→S5→S7→S6(→S7→S6→ . . . )> S7→S5(→S7→S5→ . . . )→S8=>ESM2+ESM3
P46. S4→S1→S3→S5→S7→S5(→S7→S5→ . . . )→ S8=>ESM2+ESM3
P47. S4→S1→S3→S5→S8=>ESM1
P48. S4→S1→S3→S5→S8→S6(→S8→S6→ . . . )=> ESM2
P49. S4→S1→S4→S8→S5=>ESM1
P50. S4→S1→S4→S8→S5→S7→S6(→S7→ S6→ . . . )→ S8=>ESM2
P51. S4→S1→S4→S8→S5→S7→S6(→S7→ S6→ . . . )→ S7→S5(→S7→S5→ . . . )→S8=>ESM2+ ESM3
P52. S4→S1 →S4→S8→S5→S7→S5(→S7→ S5→ . . . )→S8=>ESM2+ESM3
P53. S4→S1→S4→S8→S5→S8→ESM1
P54. S4→S1→S4→S8→S5→S8→S6(→S2→ S6→ . . . )=>ESM2
P55. S4→S1→S3→S2(→S3→S2→ . . . )→S7=>ESM2
P56. S4→S1→S3→S2(→83→S2→ . . . )→S8=>ESM2
P57. S4→S1→S4→S2(→S4→S2→ . . . )→S7=>ESM2
P58. S4→S1→S4→S2(→S4→S2→ . . . )→S8=>ESM2
P59. S4→S1→S3→S2(→S3→S2→ . . . )→ S5→S7=>ESM2
P60. S4→S1→S3→S2(→S3→S2→ . . . )→ S5→S8=>ESM2
P61. S4→S1→S4→S2(→S4→S2→ . . . )→ S5→S7=>ESM2
P62. S4→S1→S4→S2(→S4→S2→ . . . )→ S5→S8=>ESM2
P63. S4→S1→S9=>ESM1
P64. S4→S1→S9→S11→S10(→S11→S10→ . . . )→ S12=>ESM2
P65. S4→S1→S9→S11→S10(→S11→S10→ . . . )→ S11→S9(→S11→S9→ . . . )→S12=>ESM2+ESM3
P66. S4→S1→S9→S11→S9(→S11→S9→ . . . )→ S12=>ESM2+ESM3
P67. S4→S1→S9→S12=>ESM1
P68. S4→S1→S9→S12→S10(→S12→ S10→ . . . )=>ESM2
P69. S4→S1→S3→S9=>ESM1
P70. S4→S1 →S3→S9→S11→S10(→S11→ S10→ . . . )→ S12=>ESM2
P71. S4→S1→S3→S9→S11→S10(→S11→ S10→ . . . )→ S11→S9 (→511→ S9 →. . . )→S12=>ESM2+ESM3
P72. S4→S1→S3→S9→S11→S9(→S11→S9→ . . . )→ S12=>ESM2+ESM3
P73. S4→S1→S3→S9→S12=>ESM1
P74. S4→S1→S3→S9→S12→S10(→S12→ S10→ . . . )=>ESM2
P75. S4→S1→S4→S12=>ESM1
P76. S4→S1→S4→S12→S10(→S12→ S10→ . . . )=>ESM2
P77. S4→S 1→S4→S2→S9→S12=>ESM2
P78. S4→S1→S4→S2→S9→S12=>S10(→S12→ S10→ . . . )=>ESM2
P79. S4→S1→S3→S2=>ESM1
P80. S4→S1→S3→S2→S11→S10 (→511→ S10→ . . . )→S12=>ESM2
P81. S4→S1→S3→S2→S11→S10(→S11→ S10→ . . . )→S11→S9(→S11→ S9→ . . . )→S12=>ESM2+ESM3
P82. S4→S1→S3→S2→S11→S9 (S11→ S9→ . . . )→S12=>ESM2+ESM3
P83. S4→S1→S3→S2→S12=>ESM1
P84. S4→S1→S3→S2→S12→S10(→S12→ S10→ . . . )=>ESM2
P85. S4→S1→S3→S2→S12→S10(→S12→ S10→ . . . )→S12→S9(→S12→ S9→ . . . )→S12=>ESM2+ESM3
P86. S4→S1→S3→S2→S12→S9(→S12→ S9→ . . . )=>ESM2+ESM3
P87. S4→S2→S7→S8=>ESM1
P88. S4→S2→S7→S5(→S7→S5→ . . . )=>ESM3
P89. S4→S2→S5→S8=>ESM2
P90. S4→S2→S5→S8→S6→S8=>ESM3+ESM2
P91. S4→S2→S3→S5→S8=>ESM2
P92. S4→S2→S3→S5→S8→S6→S8=>ESM3+ESM2
P93. S4→S2→S8=>ESM3

P94. S4→S2→S7=>ESM2
P95. S4→S2→S5→S8=>ESM3
P96. S4→S2→S5→S7=>ESM2
P97. S4→S2→S8→S5→S8→S6→S8=>ESM3+ESM2
P98. S4→S2→S7→S5→S6→S8=>ESM3
P99. S4→S2→S7→S5→S8=>ESM2+ESM3
P100. S4→S2→S5→S8(→S5→S8→ . . . )→S6→S8=>ESM3+ESM2
P101. S4→S2→S5→S7→S5→S6→S8=>ESM3
P102. S4→S2→S5→S7→S5→S8=>ESM2+ESM3
P103. S4→S2→S4→S8=>ESM1
P104. S4→S2→S12→S9(→S12→S9→ . . . )=>ESM3
P105. S4→S2→S9→S12=>ESM2
P106. S4→S2→S9→S11=>ESM2
P107. S8→S5→S2→S4=>ESM2
P108. S8→S5→S2→S4→S1→S4=>ESM2+EMS3
P109. S8→S5→S2→S3→S1→S4=>ESM2+EMS3
P110. S8→S5→S3→S2→S4=>ESM2
P111. S8→S5→S3→S1→S4=>ESM2+ESM3
P112. S8→S5>S7→S2→S4=>ESM2
P113. S8→S5>S7→S2→S4→S1→S4=>ESM2+EMS3
P114. S8→S5>S7→S2→S3→S1→S4=>ESM2+ESM3
P115. S12→S9→S1→ESM1
P116. S12→S9→S1→S3→S2(→S3→S2→ . . . )→S4=>ESM2
P117. S12→S9→S1→S3→S2(→S3→S2→ . . . )→S3→S1(→S3→S1→ . . . )→S4=>–ESM2+ESM3
P118. S12→S9→S1→S3→S1(→S3→S2→ . . . )→S4=>ESM2+ESM3
P119. S12→S9→S1→S4=>ESM1
P120. S12→S9→S1→S4→S2(→S4→S2→ . . . )=>ESM2
P121. S12→S9→S11→S1=>ESM1
P122. S12→S9→S11→S3→S2(→S3→S2→ . . . )→S4=>ESM2
P123. S12→S9→S11→S3→S2(→S3→S2→ . . . )→S3→S1(→S3→S1→ . . . )→S4=>ESM2+ESM3
P124. S12→S9→S11→S3→S1(→S3→S1→ . . . )→S4=>ESM2+ESM3
P125. S12→S9→S12→S1=>ESM1
P126. S12→S9→S12→S1→S4→S2(→S4→S2→ . . . )=>ESM2
P127. S12→S10→S11→S3 →S1(→S3→SI→ . . . )→S4=>ESM3
P128. S12→S10→S11→S3 →S1(→S3→S1→ . . . )→S3→S2(→S3→S2→ . . . )→S4=>ESM3+ESM2
P129. S12→S10→S11→S3 →S2(→S3→S2→ . . . )→S4=>ESM3+ESM2
P130. If S13, emergency, system alarm

What is claimed is:

1. A method for confirming entry and/or exit state of a mobile object relative to an entrance of an underground passageway by utilizing Radio Frequency Identification (RFID) technology, wherein at least one RFID tag is physically attached to the mobile object and at least a first RFID reader and a second RFD reader, each having a monitoring range and being in communication with the RFID tag, are disposed at the entrance and an relatively inner position of the passageway respectively, said method comprising the steps of:

generating a first entering-state data if the RFID tag enters the monitoring range of the first RFID reader and a first exiting-state data if the RFID tag exists the monitoring range of the first RFID reader;

generating a second entering-state data if the RFID tag enters the monitoring range of the second RFID reader and a second exiting-state data if the RFID tag exits the monitoring range of the second RFID reader; and processing the first entering-state and exiting-state date and the second entering-state and exiting-state data to generate an output data indicating the entry and/or exit state of the mobile object relative to the entrance of the passageway, wherein;

generating a first entering-state data and a first exiting-state data comprises generating a first entering time if the RFID tag enters the monitoring range of the first RFID reader and generating a first exiting time if the RFID tag exits the monitoring range of the first RFID reader; and generating a second entering-state data and a second exiting-state data comprises generating a second entering time if the RFID tag enters the monitoring range of the second RFID reader and generating a second exiting time if the RFID tag exits the monitoring range of the second RFID reader.

2. The method of claim 1, further comprising providing a first backup RFID reader associated with the first RFID reader and in communication with the RFID tag, and a second backup RFID reader associated with the second RFID reader and in communication with the RFID tag.

3. The method of claim 1, further comprising:

attaching an alarm device to the mobile object;

obtaining an comparable data from an database indicating a desirable entry and/or exit state of the mobile object relative to the entrance of the passageway;

comparing the output data with the comparable data;

transmitting a signal to activate the alarm device if the output data is not compatible with the comparable data.

4. The method of claim 1, wherein processing the first entering-state and exiting-state data and the second entering-state and exiting-state data comprises comparing the time sequences of the first entering time, the first exiting time, the second entering time and the second exiting time.

5. A method for confirming entry and/or exit state of a mobile object relative to an entrance of an underground passageway by utilizing Radio Frequency Identification (RFID) technology, wherein at least one RFID tag is physically attached to the mobile object and at least a first RFID reader and a second RFID reader, each having a monitoring range and being in communication with the RFID tag, are disposed at the entrance and an relatively inner position of the passageway respectively, said method comprising the steps of:

generating a first entering-state data if the RFID tag enters the monitoring range of the first RFID reader and a first exiting-state data if the RFID tag exits the monitoring range of the first RFID reader;

generating a second entering-stage date if the RFID tag enters the monitoring range of the second RFID reader and a second existing-state data if the RFID tag exits the monitoring range of the second RFID reader;

processing the first entering-state and exiting-state data and the second entering-state and exiting-state date to generate an output data indicating the entry and/or exit state of the mobile object relative to the entrance of the passageway, and;

transmitting the output data to a display for displaying the entry and/or exit state of the mobile object relative to the entrance of the passageway.

6. A computer readable medium having computer readable program for operating on a computer for confirming entry and/or exit state of at least one mobile object relative to an entrance of an underground passageway by utilizing Radio Frequency Identification (RFID) technology, wherein at least one RFID tag is physically attached to the mobile object and at least a first RFID reader and a second RFID reader, each having a monitoring range and being in communication with the RFID tag, are disposed at the entrance and an relatively inner position of the passageway respectively, said method comprising the steps of:

generating a first entering-state data if the RFID tag enters the monitoring range of the first RFID reader and a first exiting-state data if the RFID tag exits the monitoring range of the first RFID reader;

generating a second entering-state data if the RFID tag enters the monitoring range of the second RFID reader and a second exiting-state data if the RFID tag exits the monitoring range of the second RFID reader; and processing the first entering-state and exiting-state data and the second entering-state and exiting-state data to generate an output data indicating the entry and/or exit state of the mobile object relative to the entrance of the passageway, wherein;

generating a first entering-state data and a first exiting-state data comprises generating a first entering time if the RFID tag enters the monitoring range of the first RFID reader and generating a first exiting time if the RFID tag exits the monitoring range of the first RFID reader; and generating a second entering-state data and a second exiting-state data comprises generating a second entering time if the RFID tag enters the monitoring range of the second RFID reader and generating a second exiting time if the RFID tag exits the monitoring range of the second RFID reader.

7. The computer readable medium of claim 6, wherein the method further comprises providing a first backup RFID reader associated with the first RFID reader and in communication with the RFID tag, and a second backup RFID reader associated with the second RFID reader and in communication with the RFID tag.

8. The computer readable medium of claim 6, wherein the method further comprises:

attaching an alarm device to the mobile object;

obtaining an comparable data from an database indicating a desirable entry and/or exit state of the mobile object relative to the entrance of the passageway;

comparing the output data with the comparable data;

transmitting a signal to activate the alarm device if the output data is not compatible with the comparable data.

9. The computer readable medium of claim 6, wherein processing the first entering-state and exiting-state data and the second entering-state and exiting-state data comprises comparing the time sequences of the first entering time, the first exiting time, the second entering time and the second exiting time.

10. The computer readable medium of claim 6, wherein the method further comprising transmitting the output data to a display for displaying the entry and/or exit state of the mobile object relative to the entrance of the passageway.

* * * * *